US010646989B2

(12) United States Patent
Divicino et al.

(10) Patent No.: US 10,646,989 B2
(45) Date of Patent: May 12, 2020

(54) TOOL PART CONTAINER

(71) Applicants: Andrew T. Divicino, Meriden, CT (US); Philip J. Mader, Kensington, CT (US)

(72) Inventors: Andrew T. Divicino, Meriden, CT (US); Philip J. Mader, Kensington, CT (US)

( * ) Notice: Subject to any disclaimer, the term of this patent is extended or adjusted under 35 U.S.C. 154(b) by 74 days.

(21) Appl. No.: 15/679,525

(22) Filed: Aug. 17, 2017

(65) Prior Publication Data

US 2019/0054608 A1 Feb. 21, 2019

(51) Int. Cl.
*B25H 3/00* (2006.01)
*B25H 3/02* (2006.01)

(52) U.S. Cl.
CPC ..... *B25H 3/003* (2013.01); *B25H 3/022* (2013.01)

(58) Field of Classification Search
CPC ..... B25H 3/003; B25H 3/022; B25H 3/02; B25H 3/04; B25H 3/06
USPC ..... 206/372, 379, 378, 377, 376, 443; 312/129
See application file for complete search history.

(56) References Cited

U.S. PATENT DOCUMENTS

| | | | | |
|---|---|---|---|---|
| 4,266,835 | A * | 5/1981 | Schmidt | B25H 3/02 312/244 |
| 4,303,158 | A * | 12/1981 | Perkins | B25H 3/02 206/373 |
| 5,123,532 | A * | 6/1992 | Rau | B25H 3/003 206/373 |
| 5,535,881 | A * | 7/1996 | Krivec | B25H 3/003 206/376 |
| 6,019,225 | A * | 2/2000 | Kalmakis | B01L 9/543 206/563 |
| 6,279,744 | B1 * | 8/2001 | Yu | B25H 3/022 206/372 |
| 9,844,264 | B1 * | 12/2017 | Stewart, III | A47B 81/00 |
| 2005/0211587 | A1 * | 9/2005 | Chen | B25H 3/003 206/379 |
| 2008/0303904 | A1 * | 12/2008 | Hsieh | B25H 3/02 348/159 |
| 2016/0053987 | A1 * | 2/2016 | Hsu | F21V 23/04 206/372 |

* cited by examiner

*Primary Examiner* — Robert Poon
(74) *Attorney, Agent, or Firm* — Quickpatents, LLC; Kevin Prince

(57) ABSTRACT

A tool part compartment. The tool part compartment may include a plurality of tool part compartments disposed within a container. Each tool part compartment may store a different type of tool part. Each tool part compartment may include a cell cup made of a sidewall. The sidewall has a top rim forming an opening into the cell cup. A plate is secured to the sidewall within the cell cup. The plate includes a plurality of tool slots. A lid covers the opening of the cell cup. The plate is at a distance from the lid so that a tool part disposed within one of the tool slots abuts the lid and is thereby secured in place within the cell cup.

13 Claims, 15 Drawing Sheets

TOOL PART CONTAINER

BACKGROUND OF THE INVENTION

The present invention relates to a container for tool parts and, more particularly, to container that stores each individual tool part is a secure and stable manner.

Tool parts are currently shipped in containers. Each container includes multiple compartments. Each of the compartments store a different type of tool part. Currently, the tool parts are loosely contained within each of the compartments. Therefore, it is difficult to determine how many tool parts are within each compartment without taking the tool parts out of the compartments and counting them. Without being able to quickly validate how many parts are within each compartment, tool parts are often missing, which causes significant cost due to line stops. Further, when being shipped, the tool parts knock into one another, which may cause damage.

As can be seen, there is a need for an improved tool part container that secures each tool part separately.

SUMMARY OF THE INVENTION

In one aspect of the present invention, a tool part compartment comprises: a cell cup comprising a sidewall having a top rim forming an opening into the cell cup; a plate secured to the sidewall within the cell cup, the plate comprising a plurality of tool slots; and a lid covering the opening of the cell cup, wherein the plate is at a distance from the lid so that a tool part disposed within one of the tool slots abuts the lid and is thereby secured in place within the cell cup.

In another aspect of the present invention, a tool part compartment comprises: a cell cup comprising a sidewall having a top rim forming an opening into the cell cup; a plate secured to the sidewall within the cell cup, the plate comprising a plurality of tool slots; a lid covering the opening of the cell cup; and a nut rack comprising a bridge, a shoulder protruding from an upper edge of the bridge, and a tool support protruding from an upper edge of the shoulder, wherein the shoulder is coupled to the plate within one of the plurality of tool slots and the tool support is disposed in between the plate and the lid.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Figure 1:
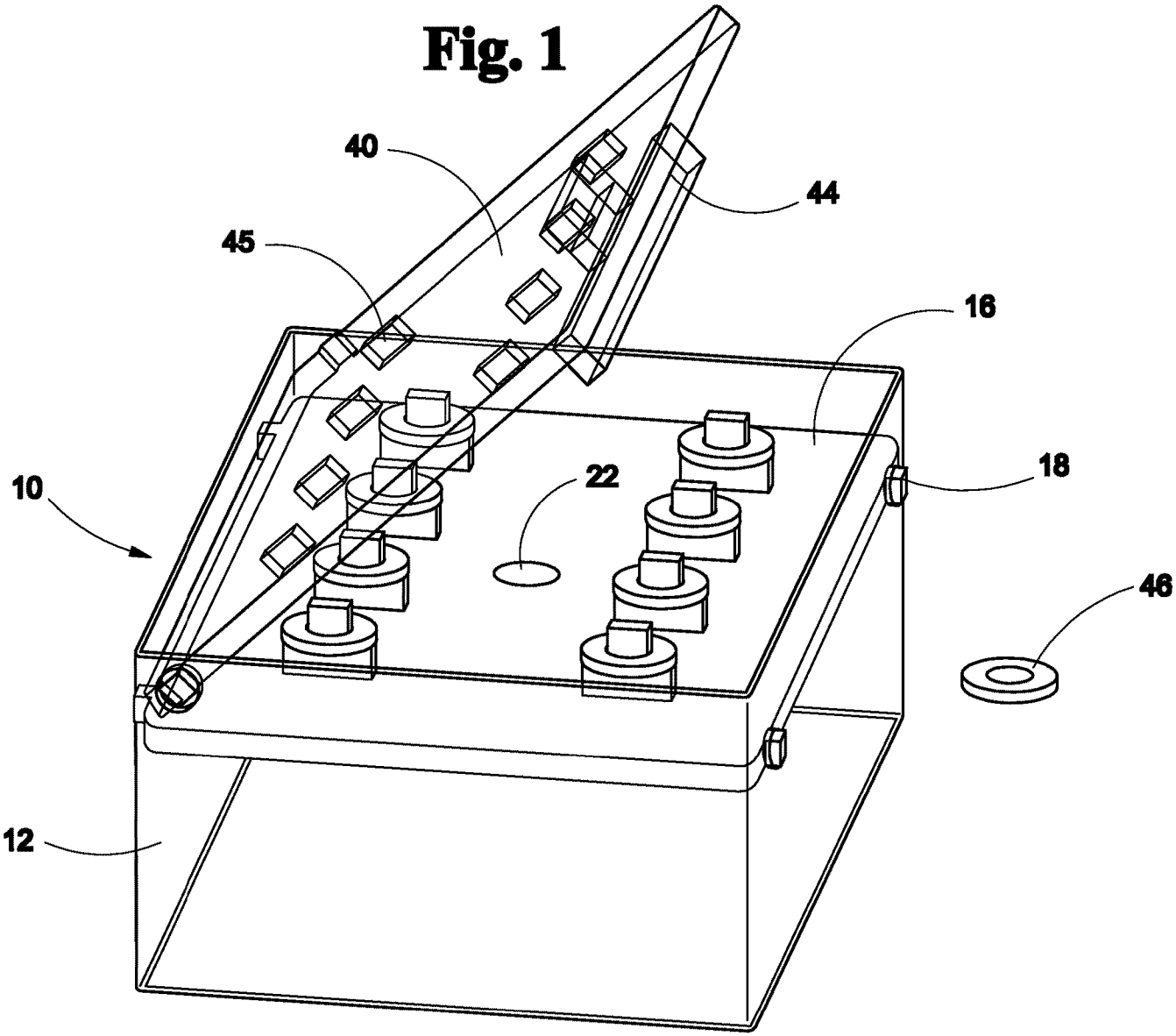
FIG. 1 is a side perspective view of an embodiment of the present invention in an open configuration.
Figure 2:
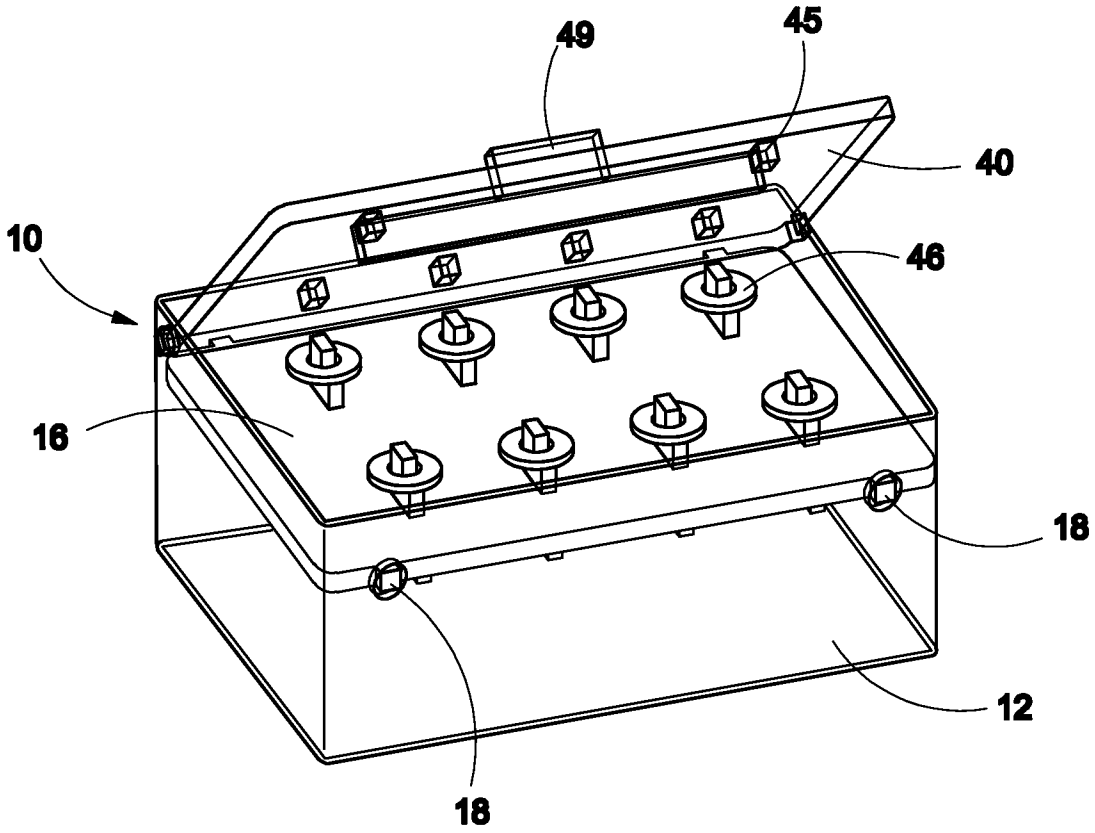
FIG. 2 is a front perspective view of an embodiment of the present invention in an open configuration.
Figure 3:
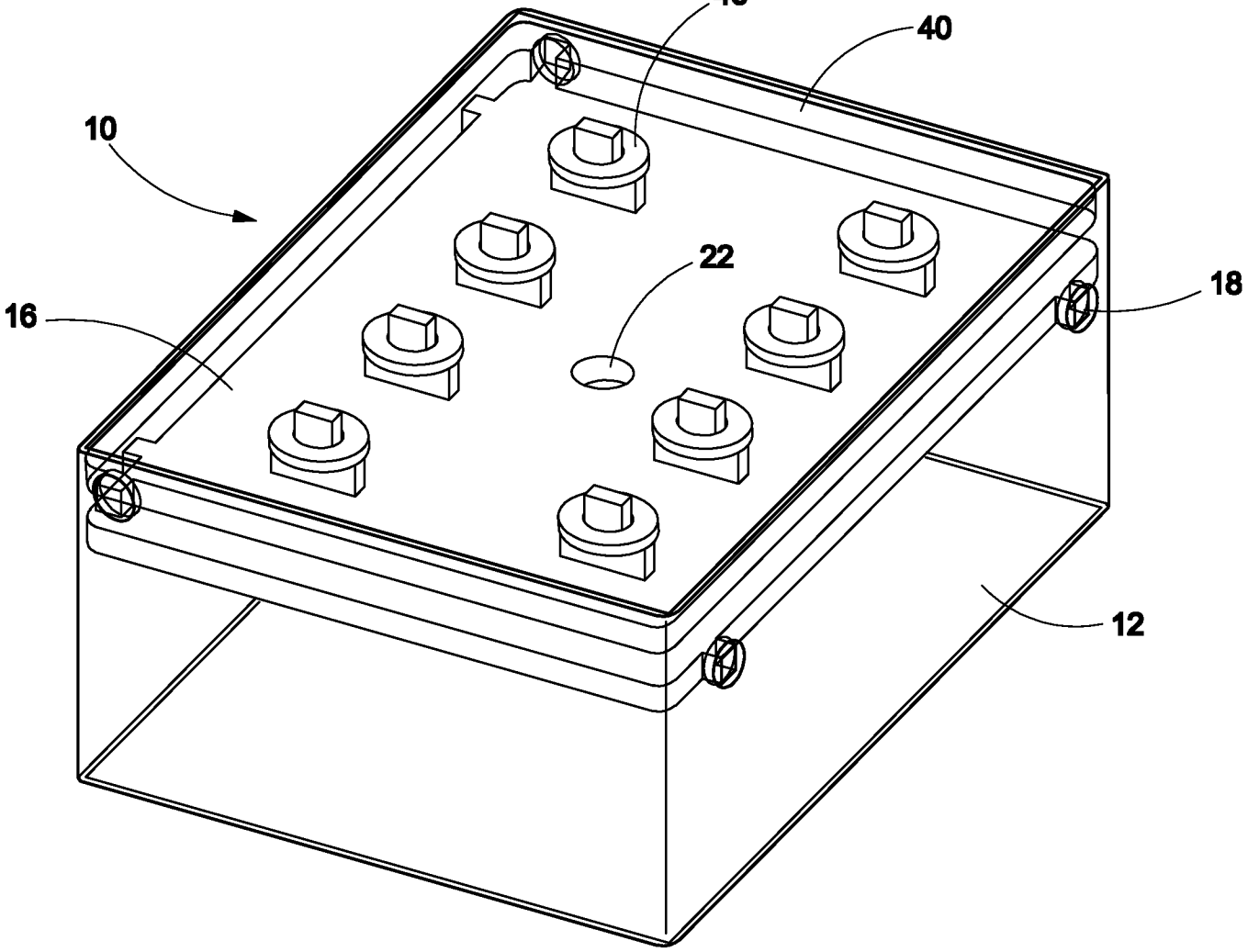
FIG. 3 is a side perspective view of an embodiment of the present invention in a closed configuration.
Figure 4:
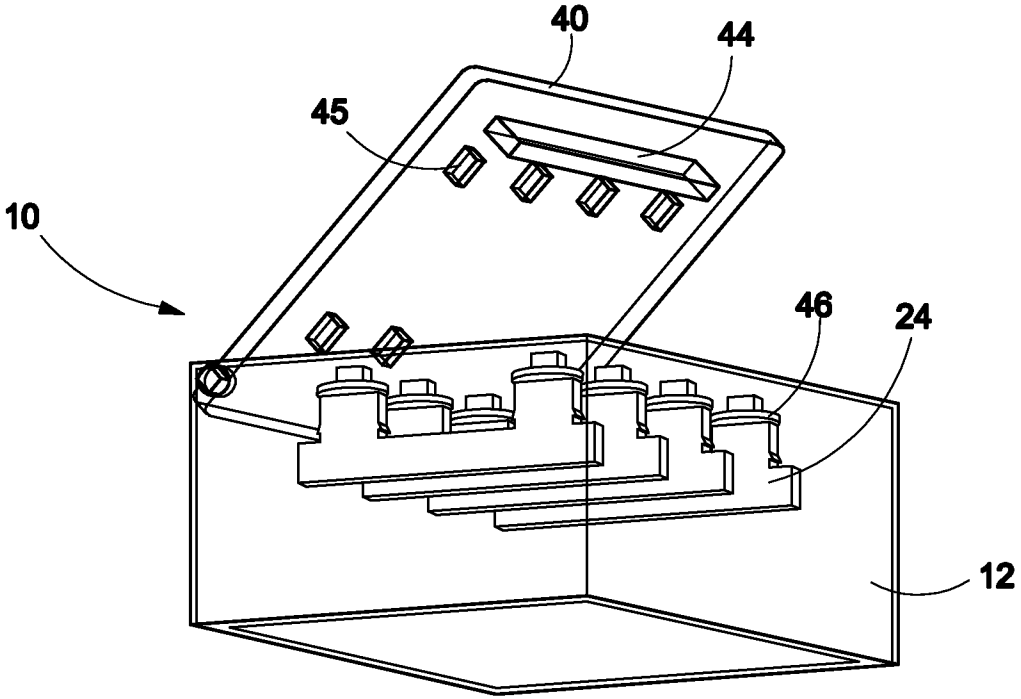
FIG. 4 is a bottom perspective view of an embodiment of the present invention in an open configuration.
Figure 5:
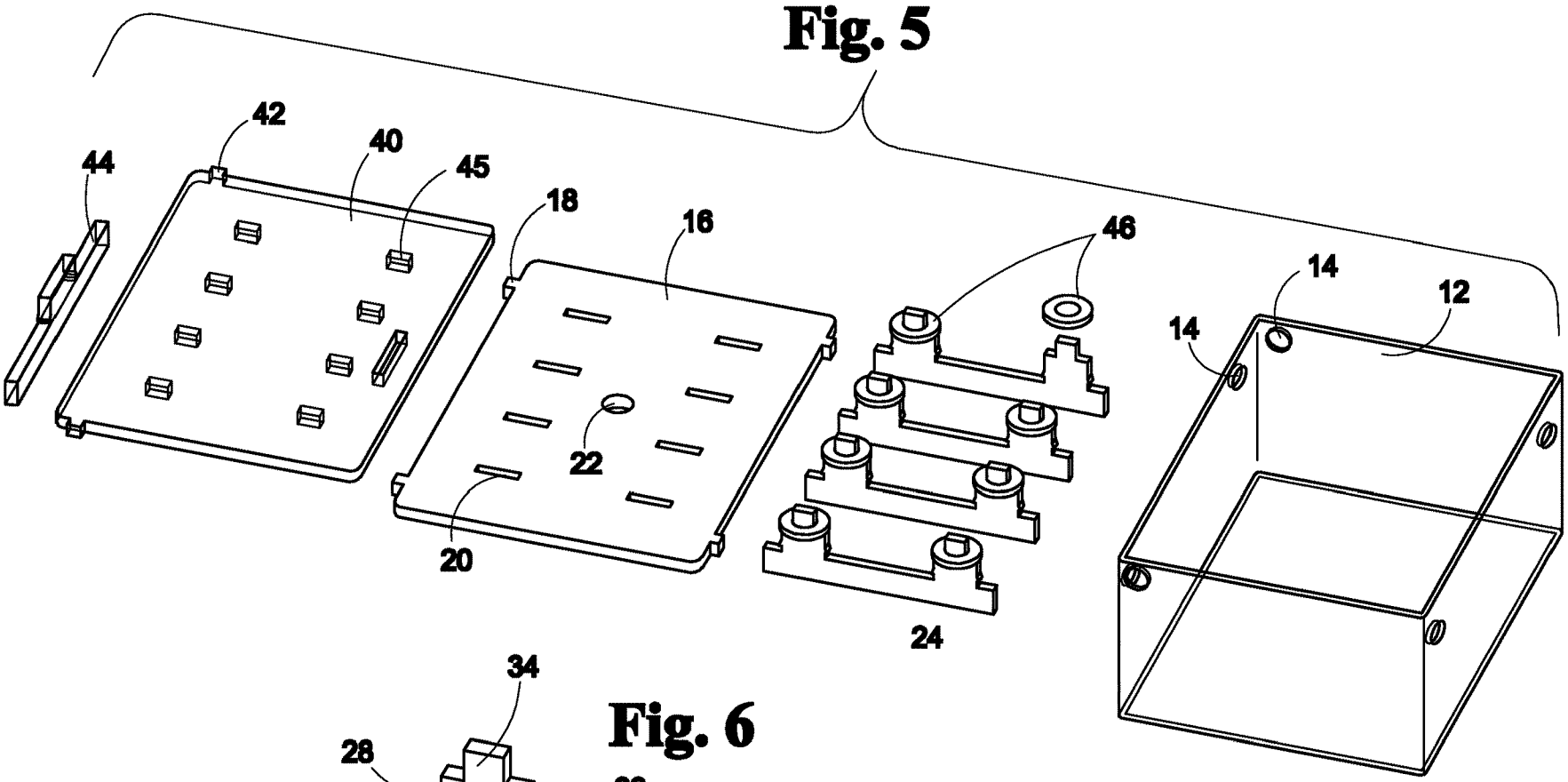
FIG. 5 is an exploded view of an embodiment of the present invention.
Figure 6:
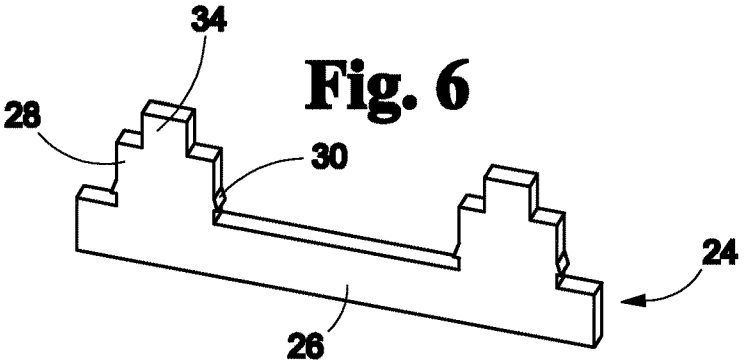
FIG. 6 is a perspective view of a nut rack of an embodiment of the present invention.
Figure 7:
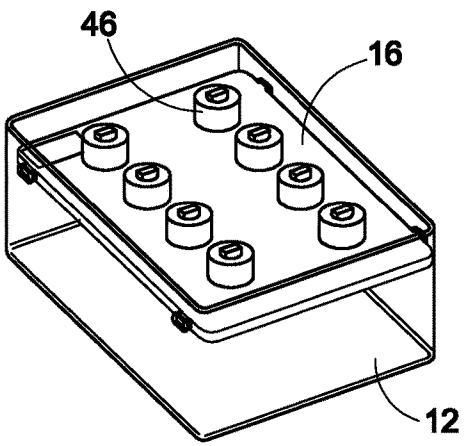
FIG. 7 is a top perspective view of an embodiment of the present invention.
Figure 9:
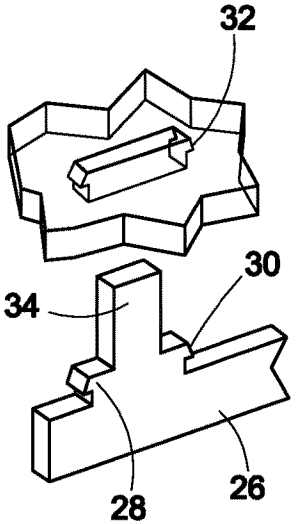
FIG. 9 is a detailed perspective exploded view of an embodiment of the present invention.
Figure 8:
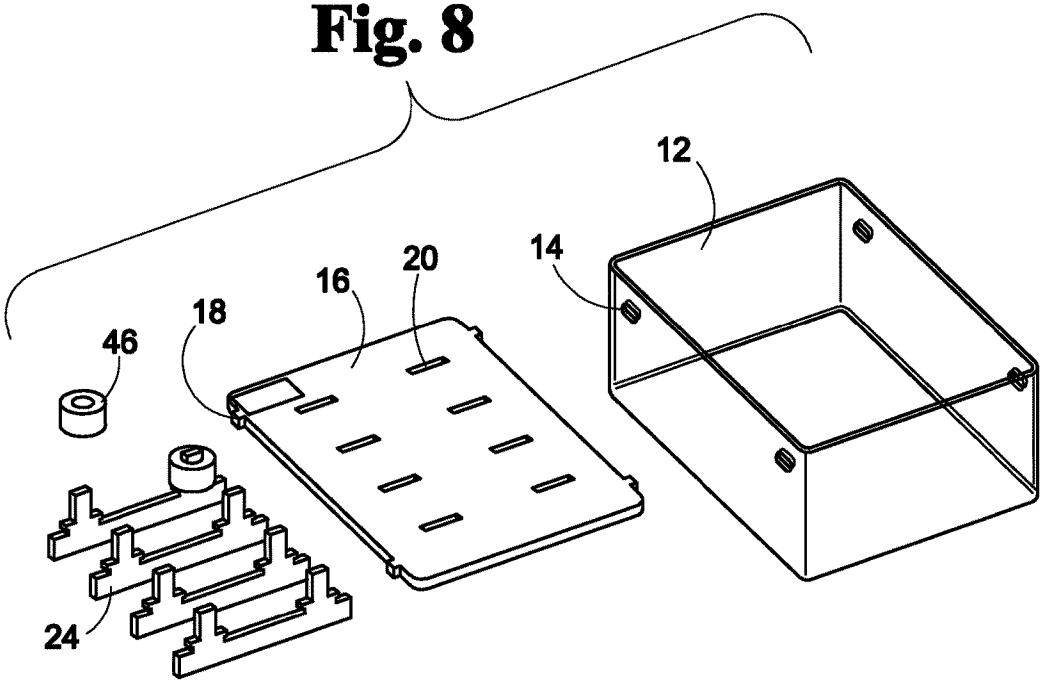
FIG. 8 is an exploded view of an embodiment of the present invention.
Figure 10:
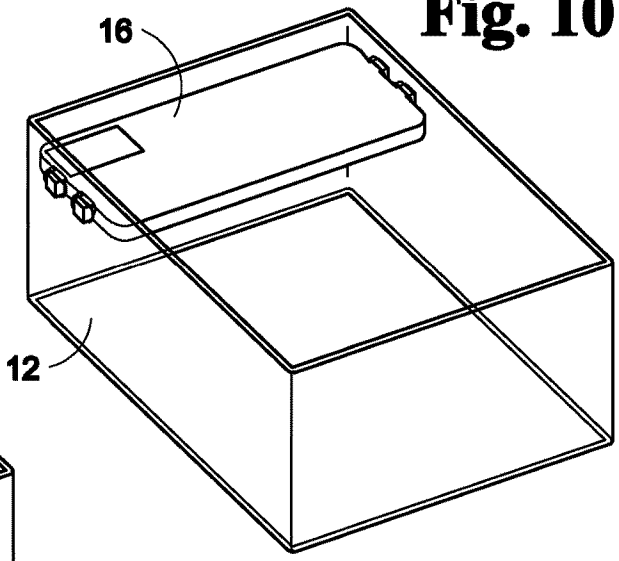
FIG. 10 is a perspective view of an embodiment of the present invention.
Figure 11:
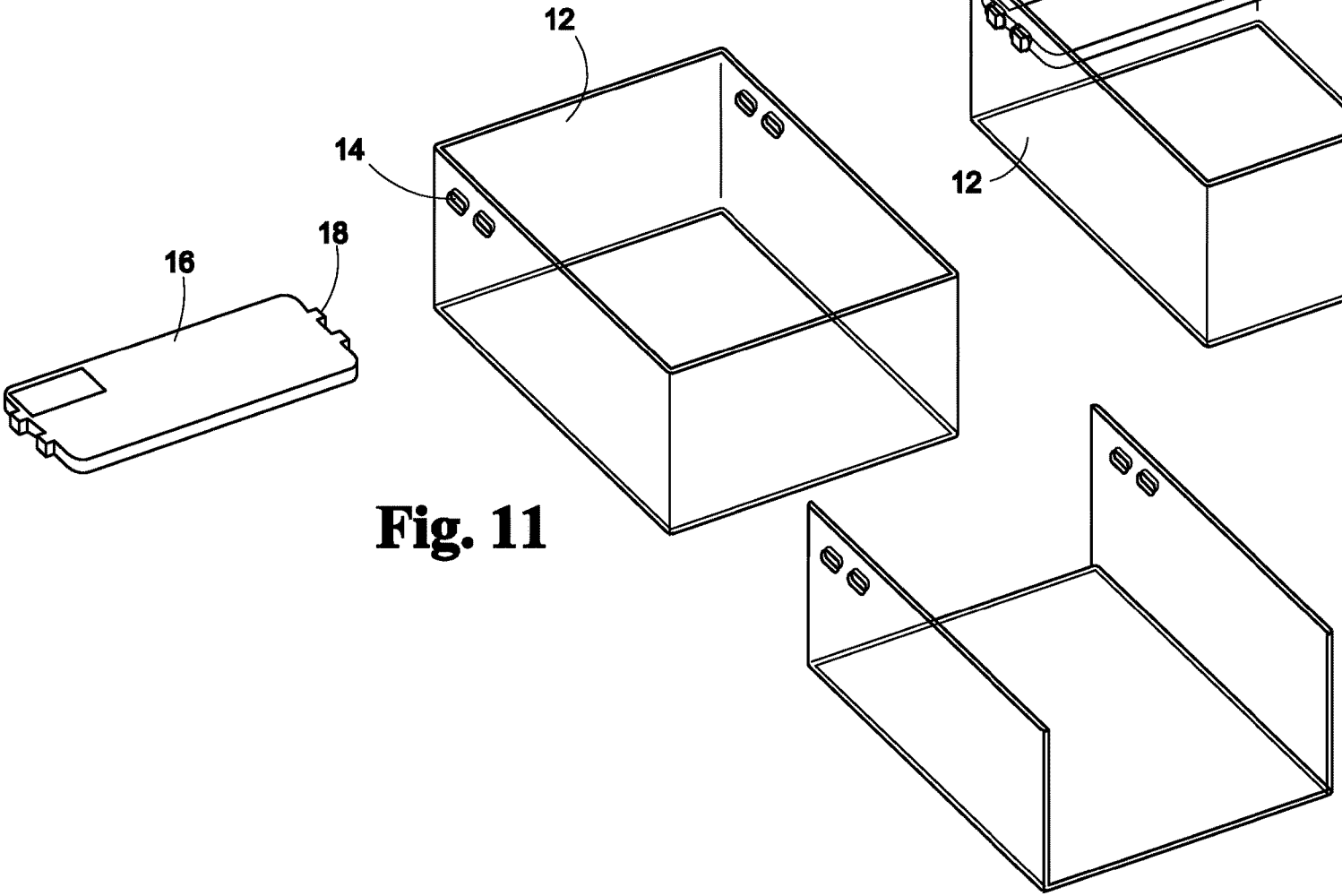
FIG. 11 is an exploded view of an embodiment of the present invention.
Figure 12:
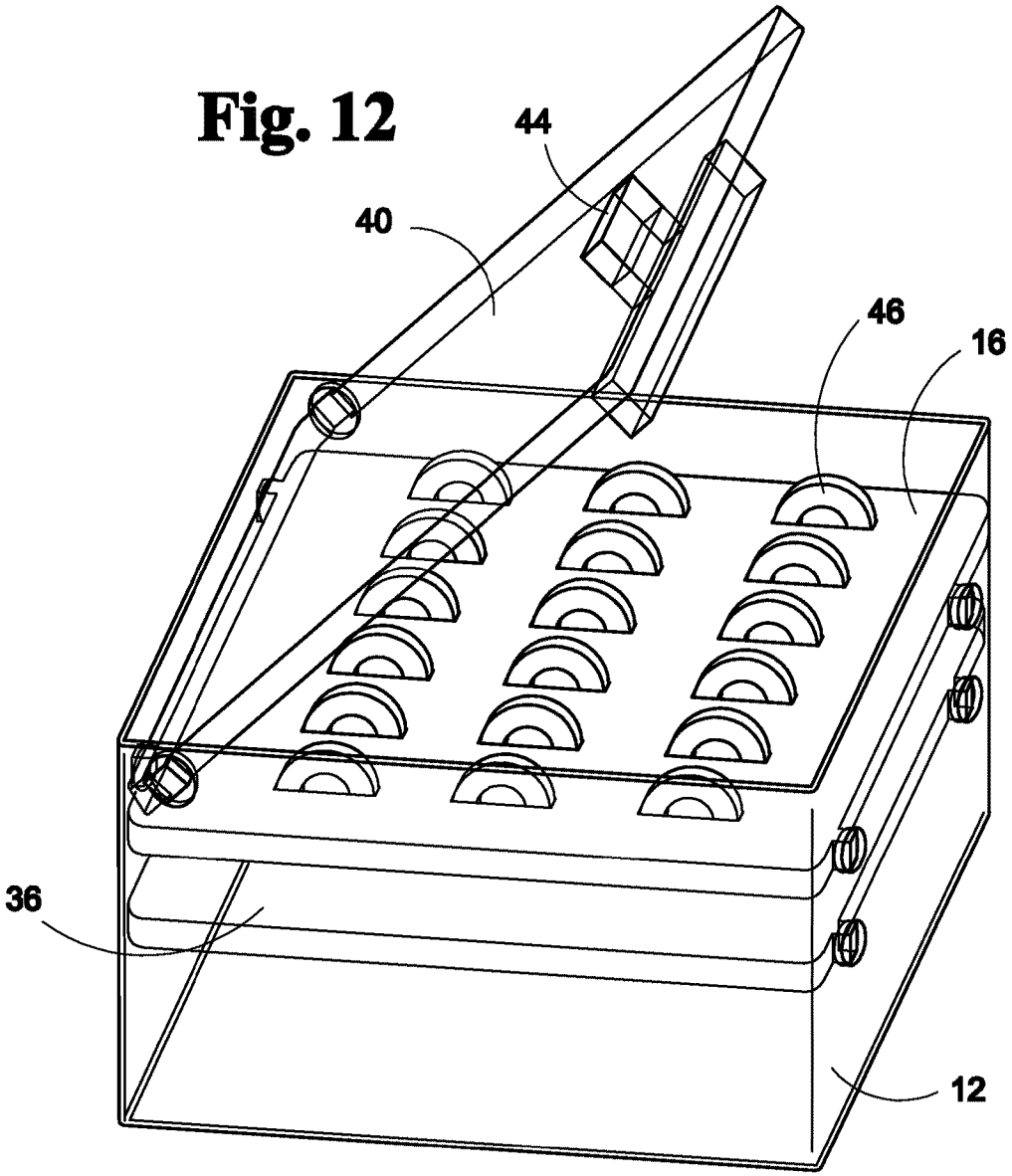
FIG. 12 is a side perspective view of an embodiment of the present invention.
Figure 13:
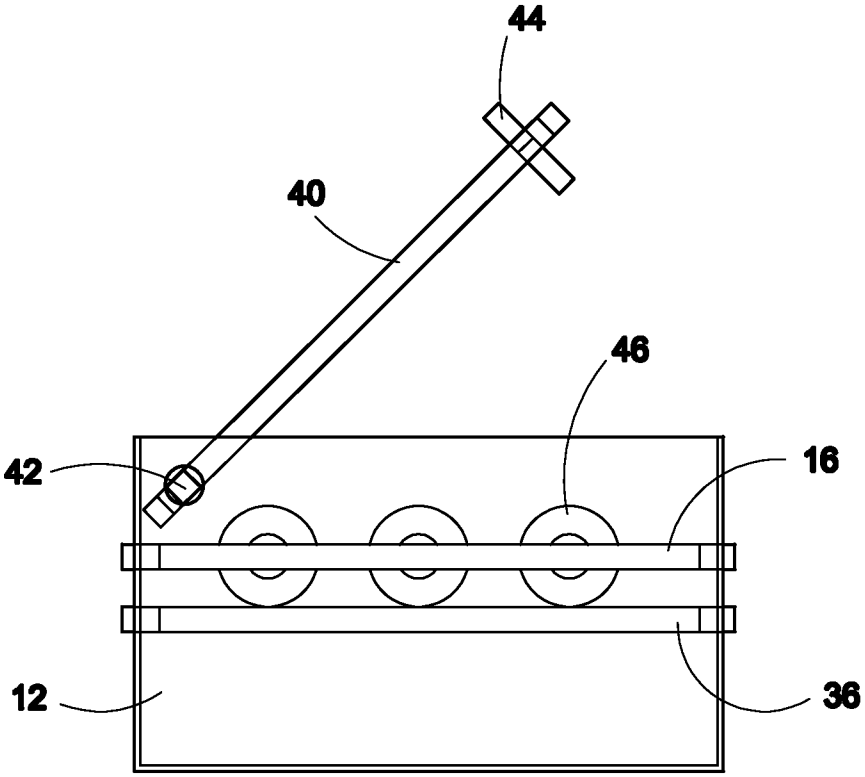
FIG. 13 is a side view of an embodiment of the present invention.
Figure 14:
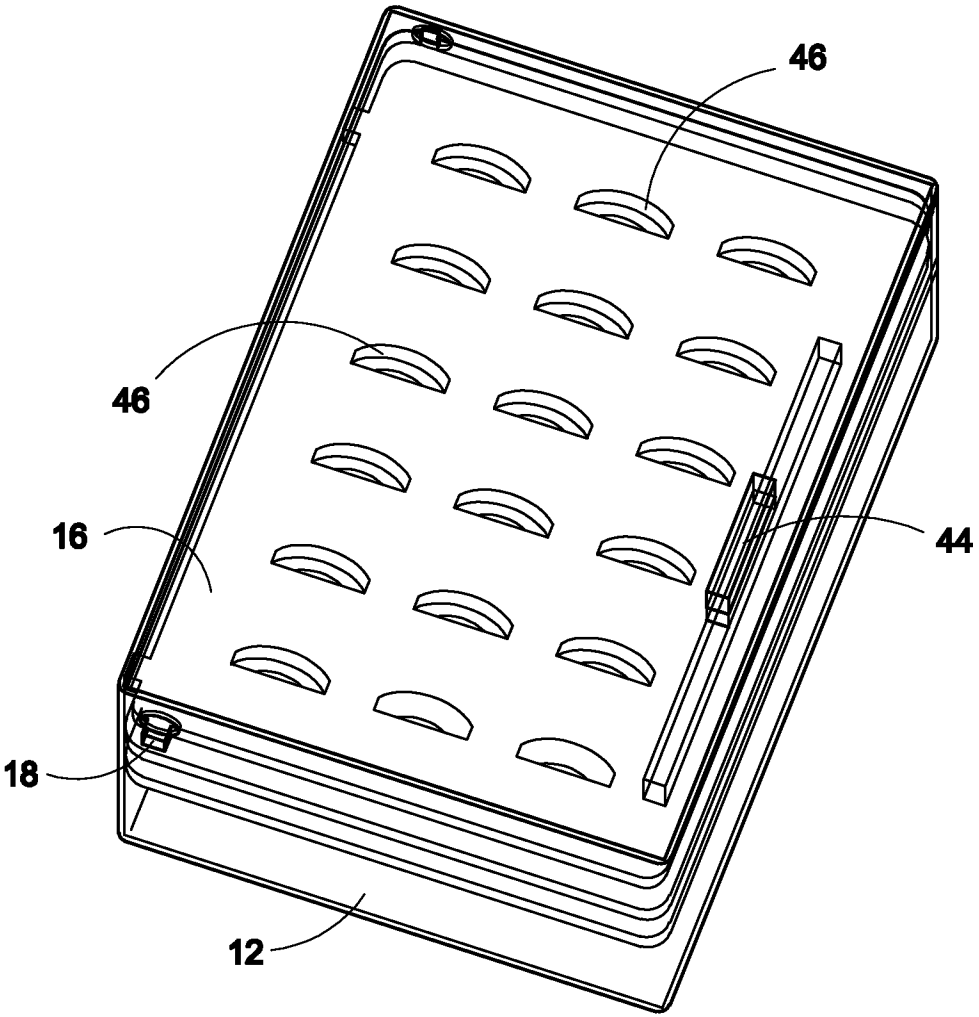
FIG. 14 is a top perspective view of an embodiment of the present invention.
Figure 15:
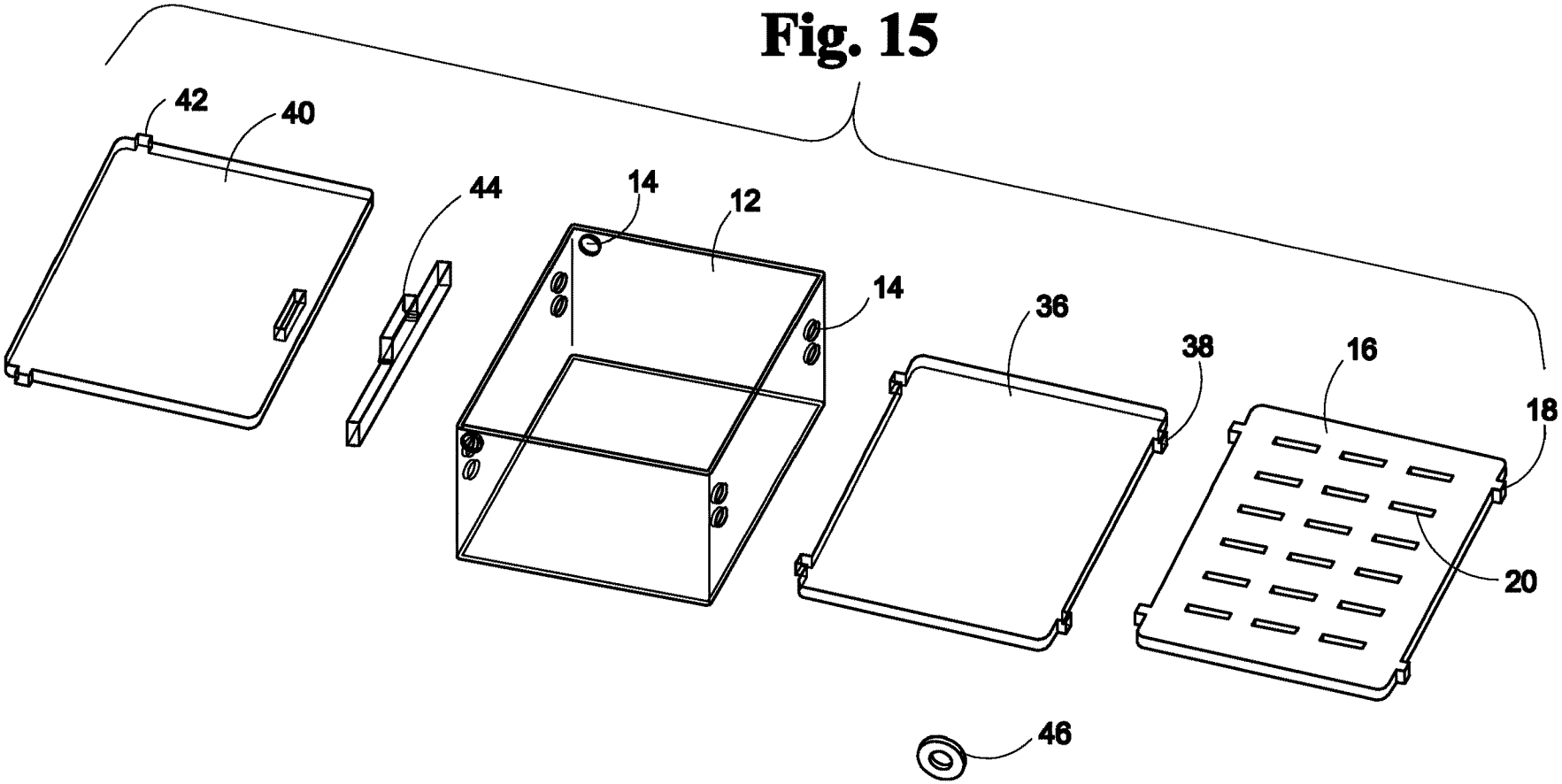
FIG. 15 is an exploded view of an embodiment of the present invention.
Figure 16:
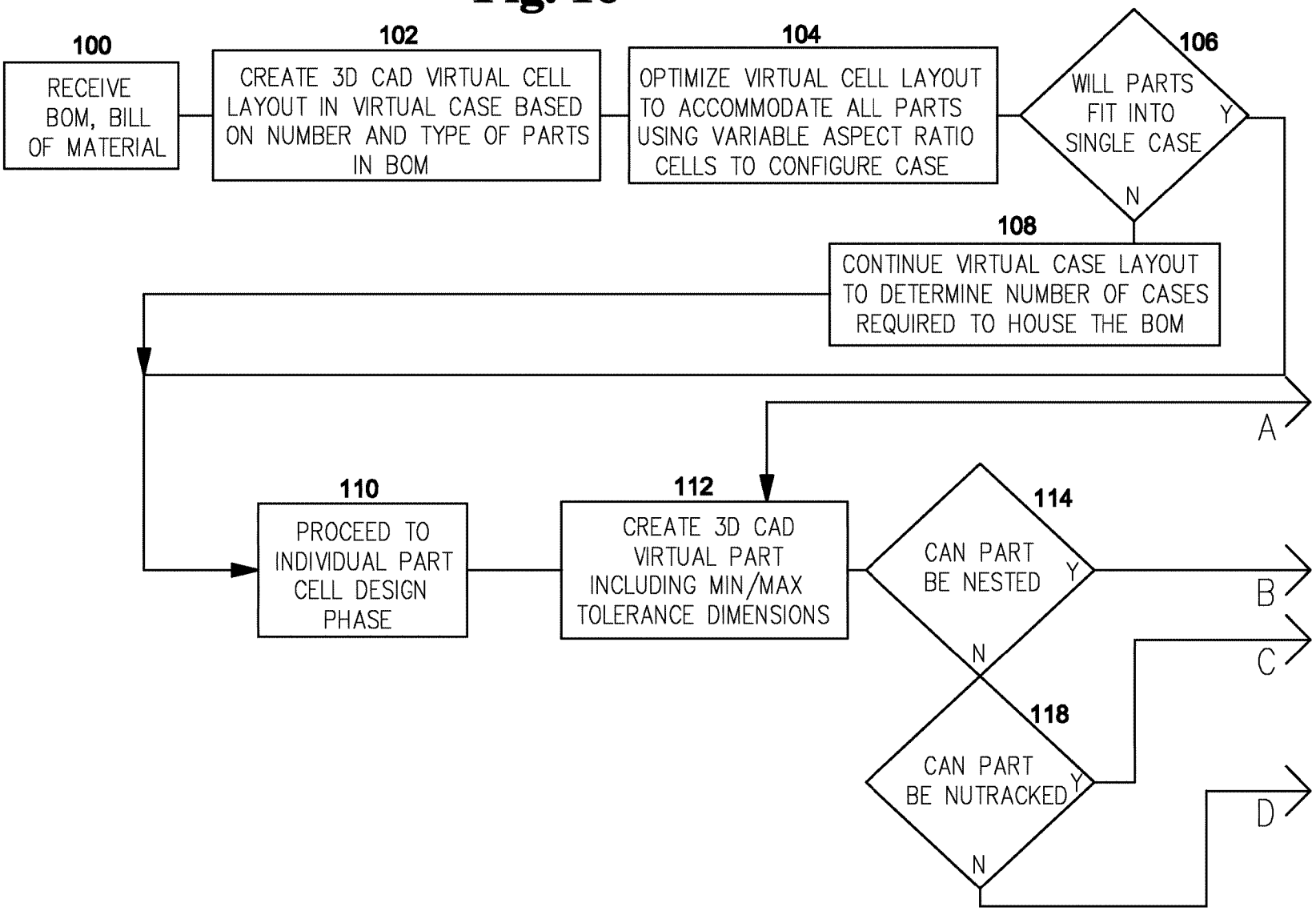
FIG. 16 is a flow chart of a method of making the present invention.
Figure 17:
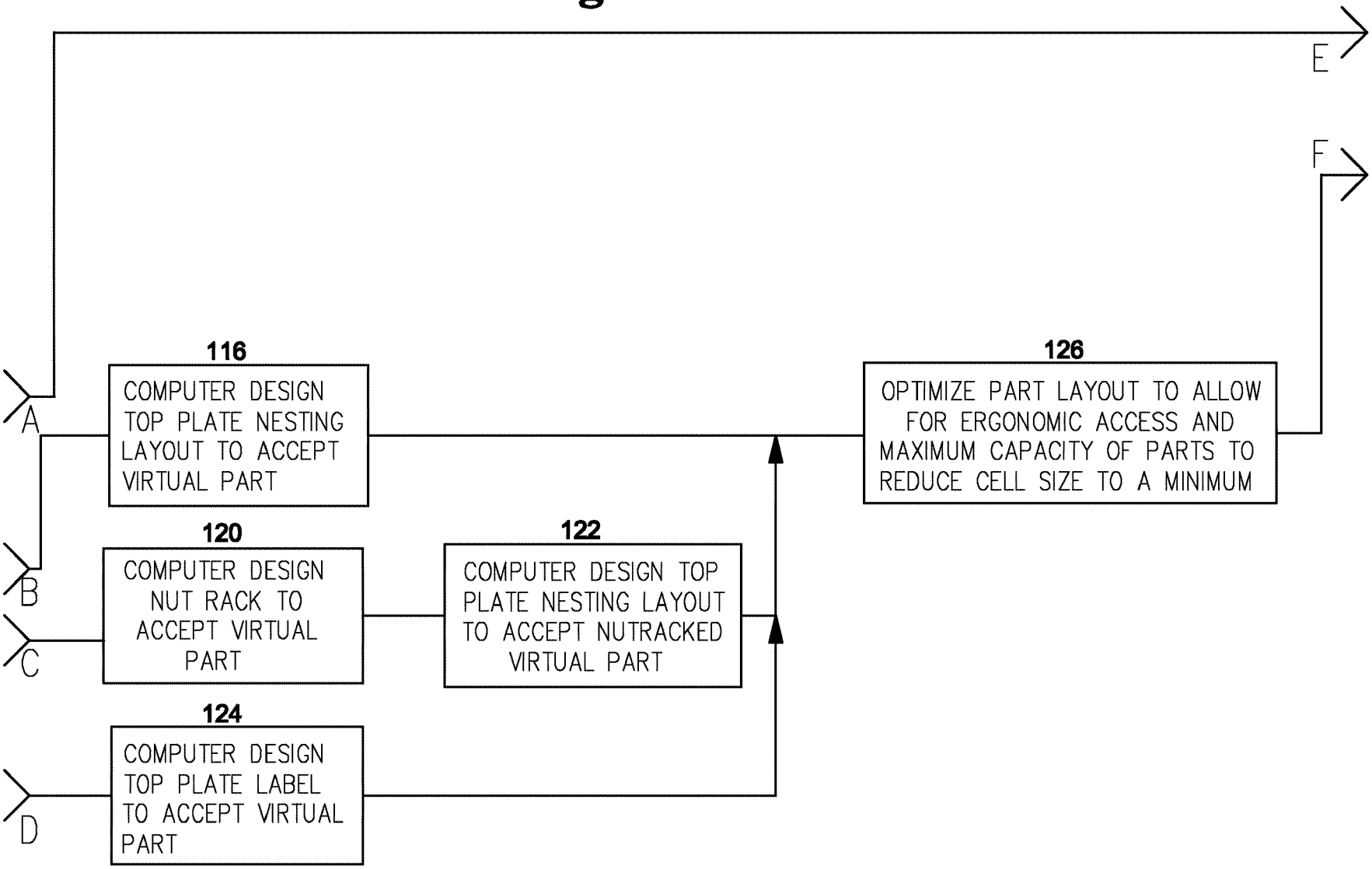
FIG. 17 is a continuation of FIG. 16.
Figure 18:
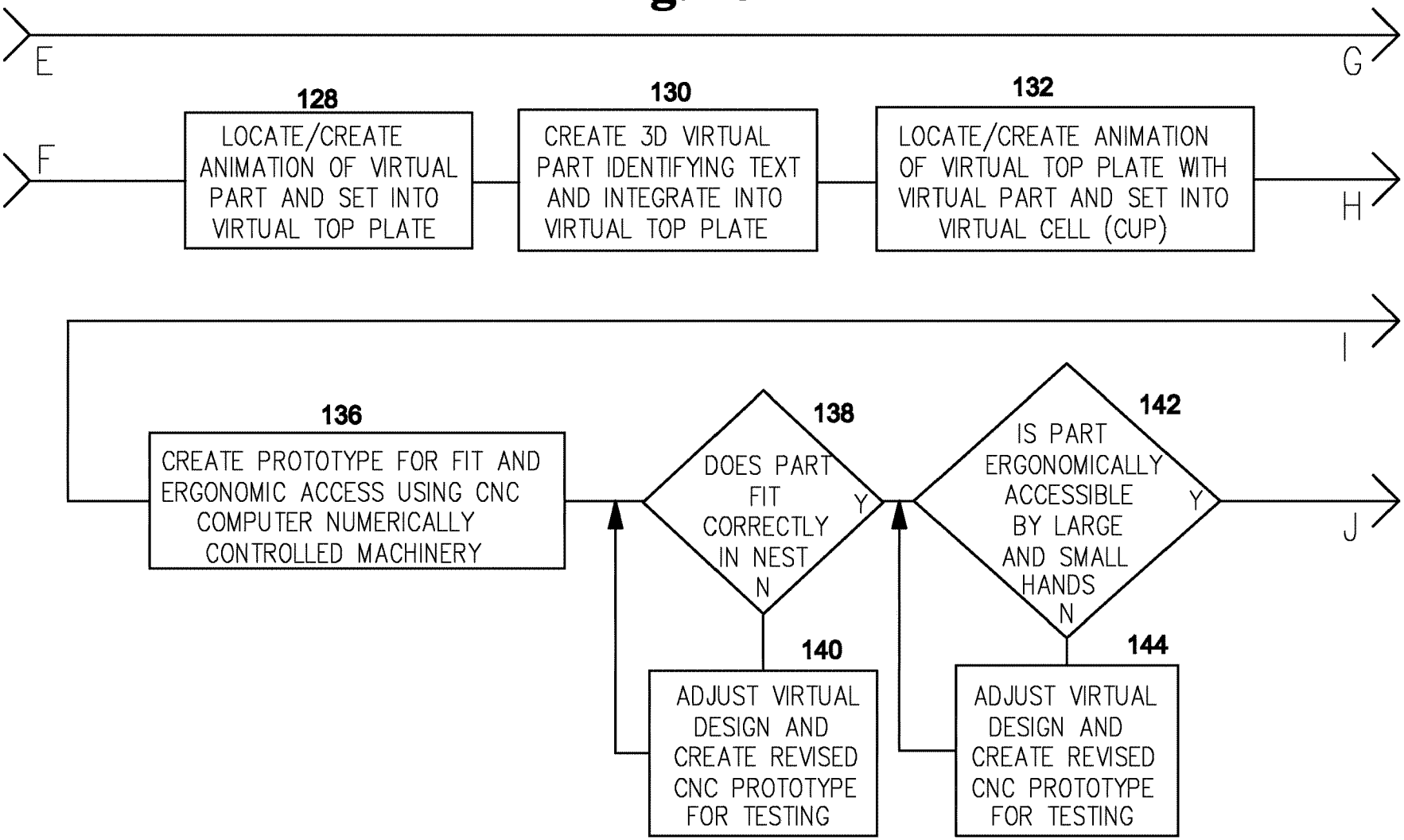
FIG. 18 is a continuation of FIG. 17.
Figure 19:
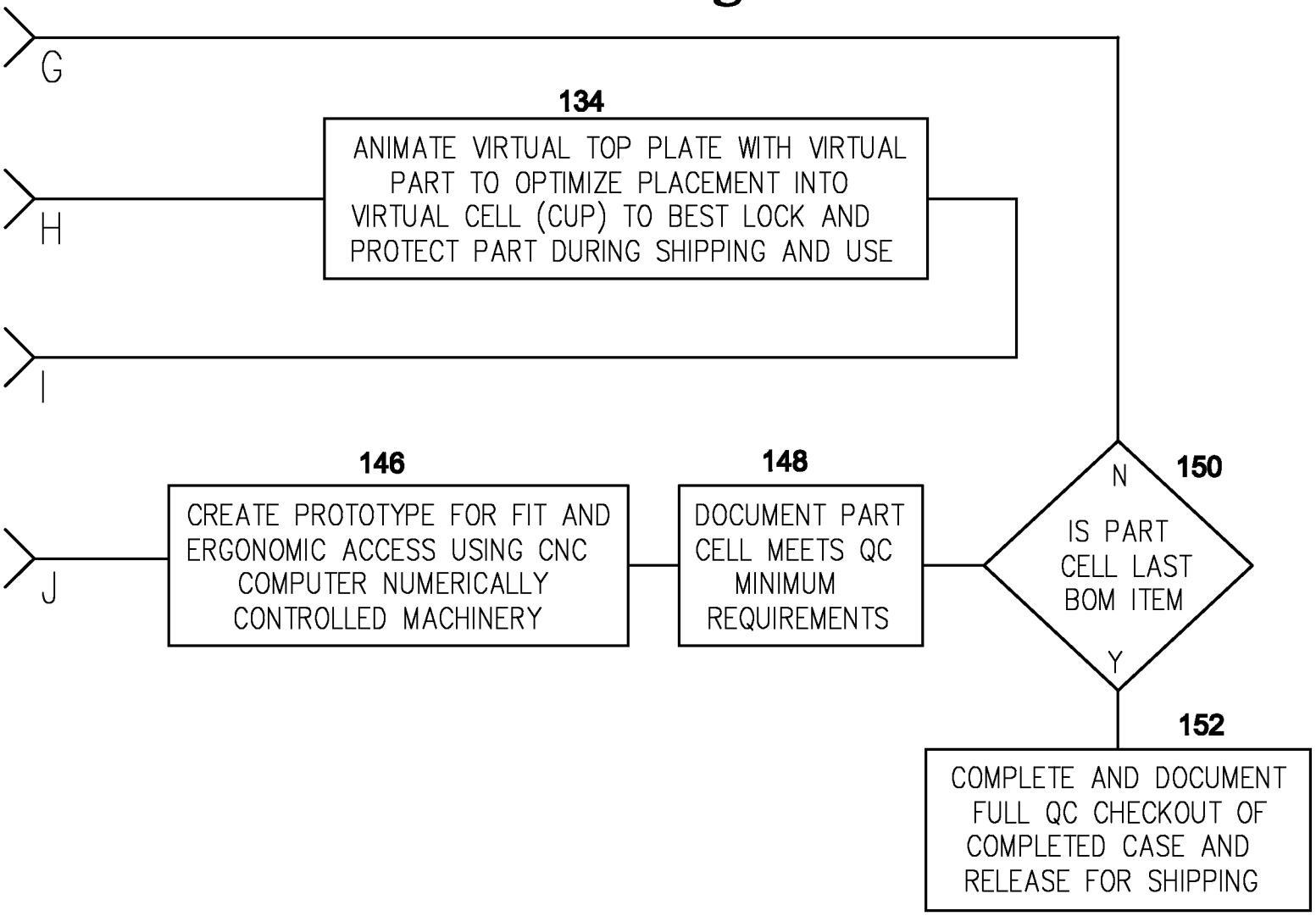
FIG. 19 is a continuation of FIG. 18.

Referring to FIGS. 1 through 19, the present invention includes a tool part compartment. The tool part compartment may include a plurality of tool part compartments disposed within a container of multiple types of tools. Each tool part compartment may store a different type of tool part. Each tool part compartment may include a cell cup 10 made of a sidewall 12. The sidewall 12 has a top rim forming an opening into the cell cup 10. A plate 16 is secured to the sidewall 12 within the cell cup 10. The plate 16 includes a plurality of tool slots 20. A lid 40 covers the opening of the cell cup 10. The plate 16 is at a distance from the lid 40 so that a tool part 16 disposed within one of the tool slots 30 abuts the lid and is thereby secured in place within the cell cup 10.

As mentioned above, the cell cup 10 includes a sidewall 12. The sidewall 12 may include a front side, a rear side, a first side and a second side. The sidewall 12 may be in the shape of a rectangle, square and the like. In certain embodiments, the cell cup 10 may include a closed bottom end. In such embodiments, the sidewall 12 further includes a base.

The plate 16 of the present invention may include a substantially flat upper and lower surface with an outer edge. The outer edge may be the same shape as the sidewall 12 with slightly smaller dimensions to snuggly fit within the sidewall 12. The plate 16 includes a plurality of tool slots 20. Each tool slot 20 is sized to fit a tool part 46 within. The plate 16 may further include a pickup point. 22. The pickup point 22 is a hole cut into the plate 16 that is slightly smaller than the tool part 46 such that the tool part 46 can partially fall into the hole and thus tilt enough for it to be picked up easily by a user's fingers without the need for additional tools.

The plate 16 may be secured within the sidewall 12 by mating connector tabs 18 and connector slots 14. In such embodiments, a plurality of connector slots 14 are formed through the sidewall and a plurality of connector tabs 18 are protruding from the edge of the plate 16. Each of the plurality of connector tabs 18 fits within a corresponding connector slot 14, releasably securing the plate 16 to the sidewall 12.

In certain embodiments, the plurality of connector slots 14 includes a first pair of connector slots 14 formed through a first side of the sidewall 12 and a second pair of connector slots 14 formed through an opposing side (second side) of the sidewall. The plurality of connector tabs 18 include a first pair of connector tabs 18 protruding from a first side of the edge of the plate 16 and a second pair of connector tabs 18 protruding from an opposing side of the edge of the plate 16. The first pair of connector tabs 18 fits within the first pair of connector slots 14 and the second pair of connector tabs 18 fits within the second pair of connector slots 14, releasably securing the plate 16 to the sidewall 12.

The present invention may further include a plurality of nut racks 24. The nut racks 24 may be used to secure nuts within the cell cup 10. The nut rack 24 may include an elongated bridge 26 having an upper edge and a lower edge. At least one shoulder 28 may protrude from the upper edge and a tool support 34 may protrude from an upper edge of the shoulder 28. The elongated bridge 28 may include a substantially flat front surface and rear surface. Therefore, the front surfaces of the bridge 26, the shoulder 28 and the tool support 34 are planar and the rear surface of the bridge 26, the shoulder 28 and the tool support 34 are planar. In certain embodiments, each of the elongated bridges 26 may include a pair or more of shoulders 28 and a pair or more of tool supports 34.

As illustrated in the Figures, the plate 16 may include four rows of two tool slots 20. In such embodiments, each of the elongated bridges 28 include a pair of shoulders 28 and a pair of tool supports 34. The shoulders 28 align with and fit within the tool slots 20. The shoulders 28 may couple to the plate 16 by a barbed connection. For example, the shoulders 28 may include a pair of male barbs 30 and the plate 16 may include pairs of female barbs 32 disposed within the tool slots 20. The pair of male barbs 30 may snap into the female bars 32, releasably securing the nut racks 24 to the plate 16. The tool supports 34 may protrude beyond the plate 16 and be disposed in between the plate 16 and the lid 40. Nuts may fit around the tool supports 34, and thereby are secured in place in between the shoulder 28 and the lid 40 within the cell cup 10.

As mentioned above, the lid 40 of the present invention is used to cover the opening of the cell cup 10. The lid 40 may include a substantially flat upper surface and lower surface with an outer edge. The lid 40 may either fit over the upper edge of the sidewall 12 or alternatively, the lid 40 may be pivotally connected to the sidewall 12. In such embodiments, the cell cup 10 may include an additional pair of connector slots 14. A pair of connector tabs 42 may protrude from opposing sides of the lid 40. The pair of connector tabs 42 may fit within the pair of connector slots 14. The lid 40 may further include a handle 44. The handle 44 may include a pair of bards that interlock with a pair of bards disposed within a handle slot of the lid 40. The handle 44 may secure within the handle slot with a grasping portion protruding above the upper surface of the lid 40. To open and close the lid 40, a user may grasp the grasping portion and lift the lid 40. The lid 40 may pivot about a horizontal axis running along the connector tabs 42 and connector slots 14, and thereby pivot open allowing a user to access the tool parts 46.

To further secure the tool parts 46 in place, the lid 40 may include a plurality of tool support slots 45 formed therethrough. The tool support slots 45 may align with the tool supports 34 of the nut racks 24. Therefore, when the lid 50 is closed, the top ends of the tool supports 34 may fit within a corresponding tool support slot 45, sandwiching the tool parts 46 in between the lid 40 and the shoulder 28 of the nut rack 24.

In certain embodiments, the present invention may be used without a nut rack 24. For example, the present invention may include a bottom plate 36. The bottom plate 36 may include a substantially flat upper and lower surface with an outer edge. The outer edge may be the same shape as the sidewall 12 with slightly smaller dimensions to snuggly fit within the sidewall 12. A plurality of connector slots 14 are formed through the sidewall and a plurality of connector tabs 38 are protruding from the edge of the bottom plate 36. Each of the plurality of connector tabs 38 fits within a corresponding connector slot 14, releasably securing the bottom plate 36 to the sidewall 12.

In certain embodiments, the plurality of connector slots 14 includes a first pair of connector slots 14 formed through a first side of the sidewall 12 and a second pair of connector slots 14 formed through an opposing side (second side) of the sidewall. The plurality of connector tabs 38 include a first pair of connector tabs 38 protruding from a first side of the edge of the bottom plate 36 and a second pair of connector tabs 38 protruding from an opposing side of the edge of the bottom plate 36. The first pair of connector tabs 38 fits within the first pair of connector slots 14 and the second pair of connector tabs 38 fits within the second pair of connector slots 14, releasably securing the bottom plate 36 to the sidewall 12.

The bottom plate 36 and the plate 16 may be secured within the cell cup 10 to stabilize tool parts 46 disposed within the tool slots 20. For example, the bottom plate 36 may be secured within the cell cup 10 beneath the plate 16 at a specified distance. The bottom plate 36 may be substantially parallel with the plate 16. The plate 16 may be secured beneath the lid 40 at a specified distance. Washers may fit through the tool slots 20. Bottoms of the washers may rest against the bottom plate 36. When the lid 40 is closed, tops of the washers may abut against the lid 40. Therefore, the washers may be secured in place within the plate 16 in between the bottom plate 36 and the lid 40.

Referring to FIGS. 16 through 19, a method of making the present invention may include the following steps: receive BOM (Bill of Material) 100; create 3D CAD virtual cell layout in virtual case based on number and type of parts in BOM 102; optimize virtual cell layout to accommodate all parts using variable aspect ratio cells to configure case 104; will parts fit into single case? 106; No: continue virtual case layout to determine number of cases require to house the BOM 108; proceed to individual part cell design phase 110; Yes: proceed to individual part cell design phase 110; create 3D CAD virtual part including Min/Max tolerance dimensions 112; can part be nested? 114; Yes: computer design top plate nesting layout to accept virtual part 116; No: can part be nut racked? 118; Yes: computer design nut rack to accept virtual part 120; computer design top plate nesting layout to accept nut racked virtual part 122; No: computer design top plate label to accept virtual part 124; optimize part layout to allow for ergonomic access and maximum capacity of parts to reduce cell size to a minimum 126; locate/create animation of virtual part and set into virtual top plate 128; create 3D virtual part identifying text and integrate into virtual top plate 130; locate/create animation of virtual part and set into virtual cell (cup) 132; animate virtual top plate with virtual part to optimize placement into virtual cell (cup) to best lock and protect part during shipping and use 134; create Prototype for fit and ergonomic access using CNC computer numerically controlled machinery 136; does part fit correctly in nest? 138; No: adjust virtual design and create revised CNC prototype for testing 140 and repeat step 138; Yes: is part ergonomically accessible by large and small hands? 142; No: adjust virtual design and create revised CNC prototype for testing 144 and repeat step 142; Yes: create Prototype for fit and ergonomic access using CNC computer numerically controlled machinery 146; document part cells meets QC minimum requirements 148; is part cell last BOM item? 150; No: start over from step 112; Yes: complete and document full QC checkout of completed case and release for shipping 152.

It should be understood, of course, that the foregoing relates to exemplary embodiments of the invention and that modifications may be made without departing from the spirit and scope of the invention as set forth in the following claims.

What is claimed is:

1. A compartment for a tool part comprising:

a cell cup comprising a sidewall having a top rim forming an opening into the cell cup;

a plate secured to the sidewall within the cell cup, the plate comprising a plurality of tool slots;

a lid covering the opening of the cell cup, wherein the plate is at a distance from the lid so that the tool part disposed within one of the tool slots abuts the lid and is thereby secured in place within the cell cup; and a nut rack comprising a bridge, a shoulder protruding from an upper edge of the bridge, and a tool support protruding from an upper edge of the shoulder, wherein the shoulder is coupled to the plate within one of the plurality of tool slots and the tool support is disposed in between the plate and the lid, the lid comprising a plurality of lid slots, wherein an upper end of the tool support fits within one of the plurality of lid slots.

2. The tool part compartment of claim 1, wherein a plurality of connector slots are formed through the sidewall and a plurality of connector tabs are protruding from an edge of the plate, wherein each of the plurality of connector tabs fits within a corresponding connector slot, releasably securing the plate to the sidewall.

3. The tool part compartment of claim 1, wherein the plurality of connector slots comprise a first pair of connector slots formed through a first side of the sidewall and a second pair of connector slots formed through an opposing side of the sidewall, and the plurality of connector tabs comprise a first pair of connector tabs protruding from a first side of the edge of the plate and a second pair of connector tabs protruding from an opposing side of the edge of the plate.

4. The tool part compartment of claim 1, wherein the nut rack comprises a pair of shoulders and a pair of tool supports.

5. The tool part compartment of claim 4, wherein the shoulder is coupled to the plate by a barbed connection.

6. The tool part compartment of claim 5, wherein the barbed connection comprises the shoulder comprising a pair of male bards that interlock with a pair of female bards of the plate formed within the slots.

7. The tool part compartment of claim 1, wherein the lid is pivotally secured to the sidewall.

8. The tool part compartment of claim 1, further comprising a bottom plate secured to the sidewall within the cell cup, the bottom plate being substantially parallel with and disposed beneath the plate.

9. A tool part compartment comprising:

a cell cup comprising a sidewall having a top rim forming an opening into the cell cup;

a plate secured to the sidewall within the cell cup, the plate comprising a plurality of tool slots;

a lid covering the opening of the cell cup; and a nut rack comprising a bridge, a shoulder protruding from an upper edge of the bridge, and a tool support protruding from an upper edge of the shoulder, wherein the shoulder is coupled to the plate within one of the plurality of tool slots and the tool support is disposed in between the plate and the lid; and wherein the lid comprises a plurality of lid slots, wherein an upper end of the tool support fits within one of the plurality of lid slots.

10. The tool part compartment of claim 9, wherein the nut rack comprises a pair of shoulders and a pair of tool supports.

11. The tool part compartment of claim 9, wherein the shoulder is coupled to the plate by a barbed connection.

12. The tool part compartment of claim 9, wherein the barbed connection comprises the shoulder comprising a pair of male bards that interlock with a pair of female bards of the plate formed within the slots.

13. The tool part compartment of claim 9, further comprising a plurality of shoulders coupled to the plate within a corresponding tool slot of the plurality of tool slots.

* * * * *